United States Patent [19]

Lödige et al.

[11] 4,015,830

[45] Apr. 5, 1977

[54] APPARATUS FOR APPLYING GLUE TO CHIPS, FIBERS AND THE LIKE

[76] Inventors: Wilhelm Lödige, Elsener Str. 9c; Fritz Lödige, Leuschner Str. 12; Josef Lücke, Im Lohfeld 13, all of 4790 Paderborn, Germany

[22] Filed: July 17, 1975

[21] Appl. No.: 596,727

[30] Foreign Application Priority Data

July 17, 1975 Germany ..... 2434358

[52] U.S. Cl. ..... 259/25; 23/313 R; 156/62.2; 156/578; 259/10; 425/200; 425/209; 118/303

[51] Int. Cl.[2] ..... B01F 7/02; B01F 15/02

[58] Field of Search ..... 156/578, 62.2, 529, 156/500, 501, 246; 425/205, 209, 200, 222; 264/8, 117; 259/84, 9, 10, 25, 26, 85, 182; 23/313, 314; 118/19, 303, 323

[56] References Cited

UNITED STATES PATENTS

| | | | |
|---|---|---|---|
| 2,834,044 | 5/1958 | Antonsen et al. | 425/222 |
| 3,493,350 | 2/1970 | Howard | 264/117 |
| 3,579,717 | 5/1971 | Middlebrooks | 264/117 |
| 3,931,377 | 1/1976 | Dollinger | 264/117 X |

*Primary Examiner*—Charles E. Van Horn
*Assistant Examiner*—M. G. Wityshyn
*Attorney, Agent, or Firm*—Walter Becker

[57] ABSTRACT

An apparatus for applying glue to chips, fibers and the like of wood, bagasse and other cellulose containing substances, which comprises a substantially cylindrical mixing chamber in which a shaft rotates equipped with radially extending mixing and/or glue applying tools. These tools immerse with their head region partly into a ring of chip material rotating at a relatively high speed. The glue applying tools comprises a glue conveying passage which in the lower region of the glue applying tools communicates with a glue feeding conduit associated with the driving shaft and in its upper region has a glue exit opening. The upper section of the glue applying tool has a glue discharge passage extending in a direction opposite to the direction of rotation of the glue applying tool. The end region of the glue discharge passage has at least one glue discharge opening.

16 Claims, 9 Drawing Figures

APPARATUS FOR APPLYING GLUE TO CHIPS, FIBERS AND THE LIKE

The present invention relates to an apparatus for applying glue to chips, fibers or the like of wood, bagasse, and other cellulose-containing substances, which apparatus is provided with a substantially cylindrical mixing chamber and a driving shaft which rotates in said mixing chamber and is equipped with mounted mixing and/or glue-applying tools which immerse at least partially with their head portion in a ring of chip material that circulates at a relatively high speed while the glue-applying tools include a glue-conveying passage which at the lower range of the glue-applying tools communicates with a conduit that is associated with the driving shaft and has at least one glue exit opening in the upper portion of said tools.

With the heretofore known device of this type, the glue exit opening is provided at the head end of the radial glue-conveying passage of the tool which is arranged on the drive shaft and which has its head immersed in the ring of chip material. The liquid glue is in this instance directly fed into the ring of chip material and thus directly onto the individual chips, fibers or the like and distributed thereby. Inasmuch as the ring of chip material to which the glue has to be applied may be of different thickness depending on the type of the material to which the glue has to be applied, these heretofore known glue-applying tools are in the gluing zone designed of different lengths in order to distribute the liquid glue uniformly over the thickness of the ring of chip material. Accordingly, the glue applying device must be equipped with tools of different lengths or the individual tools must be adjusted to differently high adjusting positions when the tools are being installed. Moreover, depending on the property of the chips of fiber materials to which the glue is to be applied, the direct introduction of the liquid glue into the ring of chip material will not always result in a uniform distribution of the glue over the chips, fibers and the like. On the other hand, a fast and optimum uniform distribution of the introduced glue over the chips or fibers is possibly desired within the gluing zone and should take place over as short as possible axial paths within the mixer. In this way the axial structural length of the gluing zone and thus the length of the entire mixer can be considerably reduced.

The direct contact of the material to which glue is to be applied with the mouth of the tool which introduces the glue, automatically brings about disorders in the flow of glue and causes the formation of deposits. The proper distribution of the glue will thus be made impossible.

It is, therefore, an object of the present invention so to design a glue-applying tool for a glue-applying device of the above mentioned general type that the glue which leaves the glue-applying tool will not directly enter the ring of chip material and thus will not be directly applied to the chip material but will be introduced through the interposition of a glue dividing path into a loosening zone of the ring of chip material while taking advantage of the centrifugal force.

These and other objects and advantages of the invention will appear more clearly from the following specification in connection with the accompanying drawings, in which.

Figure 2:
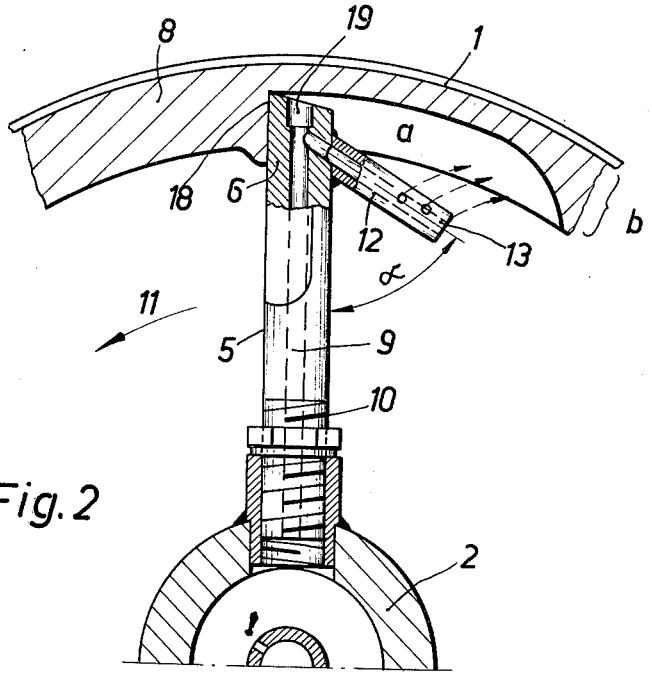
FIG. 2 illustrates a partial radial section through the drive shaft and the glue applying tool.
Figure 2A:
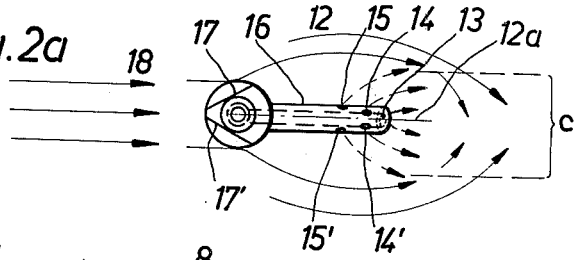

FIG. 2*a* shows a top view of a detail of FIG. 2.

Figure 3:
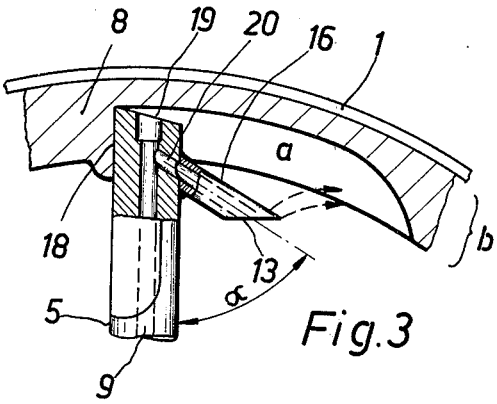
Figure 3A:
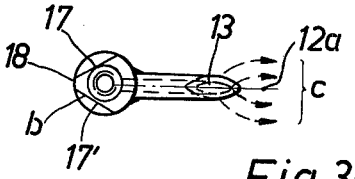

FIGS. 3 and 3*a* illustrate, similar to FIGS. 2 and 2*a*, a modified structure according to the present invention.

Figure 4:
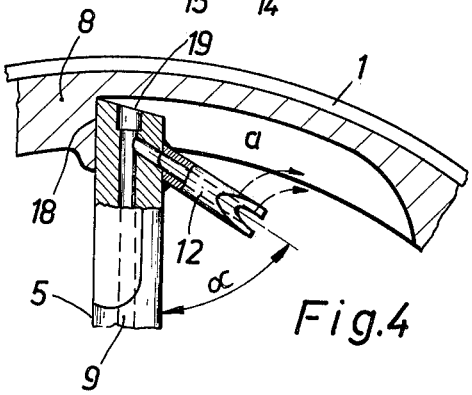
Figure 4A:
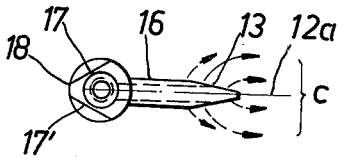

FIGS. 4 and 4*a* illustrate still another modification of the glue-applying device of the present invention.

Figure 5:
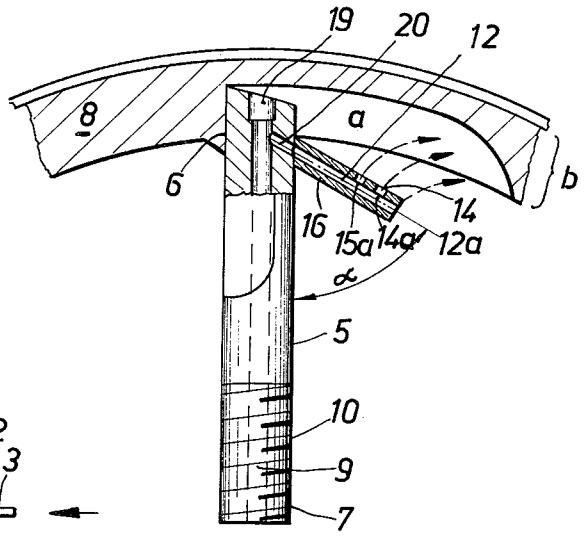
Figure 5A:
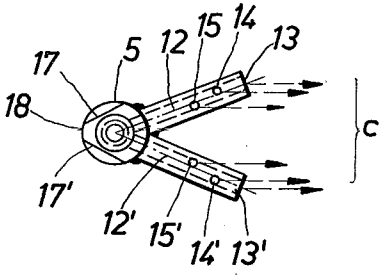

FIGS. 5 and 5*a* represent still another modification of the device according to the invention.

The apparatus according to the present invention is characterized primarily by at least one glue delivery passage which is arranged at the head of the glue-applying tool while being directed opposite to the direction of circulation, the end section of said glue delivery passage comprising at least one glue exit opening.

Due to the positioning of the glue exit opening at a place which when viewed in the direction of rotation is located in spaced relationship to and behind the head proper of the glue-applying tool and outside the ring of chip material, it is brought about that the head of the glue-applying tool during the rotation of the ring of chip material can plow through the latter while within the ring of mixing material a loosening-up zone is formed directly behind the glue-applying head, into which zone the glue is sprayed in finest distribution by centrifugal force from the interior or from the center.

Figure 1:
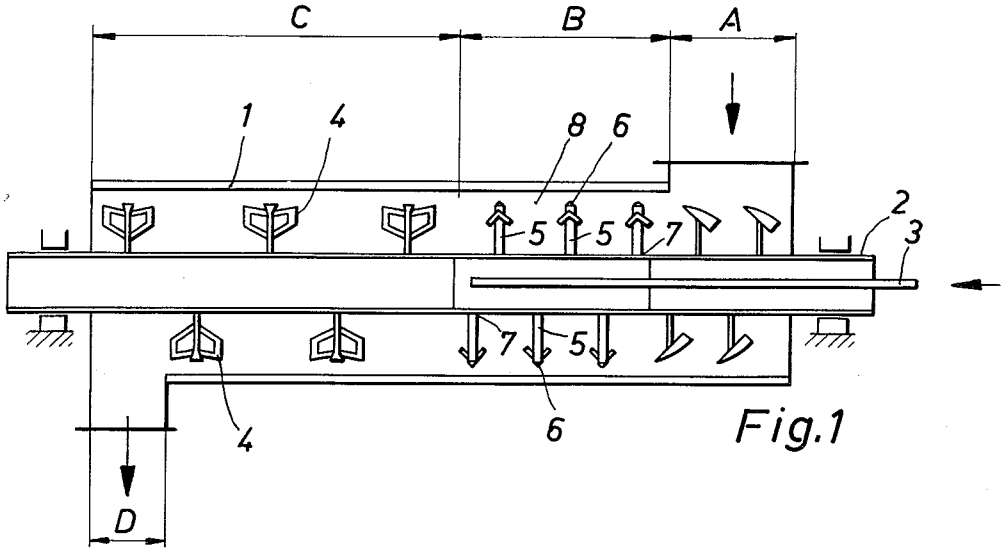
FIG. 1 represents an axial section through the diagrammatically illustrated overall structure of a glue-applying device according to the invention.

Referring now to the drawings in detail, and FIG. 1 thereof in particular, the mixing apparatus illustrated in FIG. 1 shows a cylindrical or oval mixing chamber 1 in which, preferably centrally, there is journalled a drive shaft 2. The reference character A designates the chip incoming region which is followed by the gluing zone B proper. In this incoming region of the mixing chamber 1, the drive shaft, for instance by the provision of a central feed passage 3, is hollow. Through this feed passage 5, the liquid glue to be discharged is conveyed to the mixing tools 5 in the glue-applying zone B and from the latter is centrifuged due to the centrifugal action.

In the mixing zone C proper, there are located the mixing tools 4 which following the application of glue to the chip material rotating in a ring 8 of chip material bring about the mixing and the further transport of the ring of chip material to the exit D.

The glue-applying tools 5 are within the lower region 7 provided with a thread 10 by means of which said tools 5 are so screwed onto the drive shaft 2 that the head 6 of each glue-applying tool 5 immerses into the ring 8 of chip material. The glue-applying tool 5 according to the invention has a radially extending bore which forms the glue-conveying passage 9. The liquid glue flows through said bore from the glue-feeding line 3 of the drive shaft 2 into the glue-conveying passage 9, enters the glue-discharge passage 12 which extends at an acute angle$\alpha$ with regard to the glue-conveying passage 9, and is then centrifuged out from the glue exit opening 13 which points in opposite direction of rotation 11 of the tool 5. The glue-conveying passage 9 is closed at the head 6 by an insert member 19 fitted therein. The head 6 runs in the direction of rotation 11 ahead of the glue exit opening 13 while plowing through the ring of chip material having a thickness B so that directly behind the head 6, so to speak in the suction of the tool head 6 running ahead, a loosening up or groove a is formed. The liquid glue which is centrifuged out from the opening 13 of the glue discharge passage 12 is in finely divided condition centrifuged into the said loosening zone or groove a. The glue discharge passage may also be formed by a simple pipe 16 welded to the back side of the glue-applying tool 5 and by means of a connecting bore 20 communicates with the glue-conveying passage 9 proper. The projecting glue discharge pipe 16 and thus the glue discharge passage 12 forms an acute angle $\alpha$ with the passage 9.

Due to the invention, a proper cooling of the glue-applying tool, especially also of the head 6 extending through the ring of chip material, is obtained. The design of the tool 5 may be effected primarily in conformity with the intended loosening and/or mixing function without taking into consideration the arrangement of the glue exit openings. Accordingly, with a corresponding design of the head 6 or of the entire tool 5, it is possible to obtain a furrow or channel in conformity with the glue dividing path, and thus a loosening zone is prepared in an optimum manner, into which loosening zone the glue is centrifuged from the pipe 16 which has a smaller cross section. Depending on the conditions, a single glue exit opening for instance the opening 13 of the glue exit passage 12 may suffice. The exit opening 13 located along the axis 12*a* of the glue exit passage 12 may, depending on the prevailing conditions, for obtaining a desired glue division of split-up, have in the loosening zone a an exit cross section which differs from the circular shape. In FIGS. 3, 3*a*, this exit cross section is designed in the form of an ellipse by the inclined cut off section of the glue exit pipe 6. The glue which passes through the passage 12 flows through the opening 13 at the rim of this opening and is centrifuged off from said rim in conformity with the illustrated dash line arrows.

The embodiment of FIGS. 4, 4*a* shows a mouth-shaped design of the opening 13 in such a way that the upper and lower lip of this opened mouth are located one above the other when viewed in radial direction so that the exit cross section itself decreases in an arc-shaped manner from the outside toward the inside. Also in this instance, the glue is in conformity with the arrows illustrated in FIG. 4 divided over a wider zone than is the case with the arrangement of a single opening. Principally, any cross sectional shape and any arrangement for one or more exit openings is possible. Thus, as will be seen from FIGS. 2, 2*a* and 5, 5*a*, in addition to the glue exit opening 13, additional exit openings 14, 14′; 15, 15′ may be arranged preferably on that side of the glue exit passage 12 which faces toward the ring 8 of the chip material. The axes 14*a*, 15*a* of these exit openings 14, 15 are located at an angle with regard to the axis 12*a* of the glue exit passage 12. This angle may amount to 90° or less. Due to the arrangement of a plurality of glue exit openings within the end region of the projecting glue exit pipe 16 which may for instance be contracted to form a small slot, the dividing of the glue may be effected in conformity with the respective conditions according to the type of chip material, density of the ring of chip material, and the thickness of the ring of chip material, especially in conformity with the dimensions of the head 6. In this connection it is also possible to arrange the openings exclusively on the mantle surface of the pipe 16 or exclusively to provide a greater exit opening at the end of the pipe in conformity with the glue discharge opening 13, or in addition to this opening 13, one or more openings for instance 14, 15 may be provided on the mantle surface of the pipe in a desired size and arrangement. It is suggested that the exit openings 14, 14′; 15, 15′ which are to be arranged on the mantle surface be arranged symmetrically preferably in pairs, to the central axis 12*a* (See FIG. 2*a*). Due to the arrangement of the exit openings in conformity with the respective conditions, a uniformly wide glue distribution can be effected in the loosening zone. Advantageously, the cross sections of the exit openings 14, 14′; 15, 15′ which are inclined at an angle to the glue discharge passage 12 are smaller than the cross section of the glue discharge passage 12. The openings may also have a conical slot or nozzle shape.

Due to the design of a glue discharge passage 12 which is particularly connected to the glue applying tool 5 and supported thereby and has the shape of a pipe 16 projecting from the tool 5, the tool 5, especially the tool head 6 may have a shape which corresponds to its loosening function without the glue supply being affected thereby in any manner. This embodiment shows a design in which the head 6 of the glue-applying tool 5 has a cross section which decreases in the direction of rotation 11. This cross section defines substantially an isosceles triangle in which the two equal legs 17, 17′ (see FIGS. 2*a*–5*a*) meet in a V-shaped manner in the direction of rotation so as to form a tip 18. With a cross sectional design of this type, at the front side of the head 6 or of the entire tool 5 there is provided a preferably rounded edge which separates the ring of chip material without great resistance and moves apart the chip material along the flanks formed by the legs 17, 17′ so that a wide loosening zone will be formed.

The present invention creates a glue-applying tool which relative to heretofore known one-pipe tools with a top exit opening by means spatially separated from each other creates a wide glue dividing path and furthermore forms a furrow-shaped loosening zone into which the defined divided glue is centrifuged. Thus, in the glue-applying zone there occurs an unequivocal undisturbed better glue division and improved glue distribution. This advantageous effect can according to the invention furthermore be greatly improved when according to the embodiment of FIGS. 5, 5*a*, two or more glue discharge passages 12, 12′ are provided which are located in a V-shaped manner relative to each other and which have corresponding openings 13, 13′ and/or corresponding openings 14, 14′ or 15, 15′ on the mantle surface of the projecting glue discharge pipes. A such rearwardly diverging arrangement of at least two glue discharge pipes increases the glue dividing width or the glue dividing path directly after the exit from said openings. This glue dividing width is in the individual illustrations designated with the letter *c*. Due to the glue division according to the invention, also the glue distribution occurring between the individual chips is considerably facilitated and more specifically already in the glue-applying zone. This is due to the fact that a lateral material push exists between adjacent tools which are successively offset and timewise follow each other so that the respective successive tools will be able to spread the glue which was dispensed by the preceding tool.

In the illustrated embodiments, the glue exit openings 13, 14, 15 are located outside the ring 8 of chip material. However, it is also possible that the said glue exit openings are at least in part located inside the ring of chip material and more specifically in the loosening zone *a* formed by the head.

It is, of course, to be understood that the present invention is, by no means, limited to the specific showing in the drawings, but also comprises any modifications within the scope of the appended claims.

What we claim is:

1. An apparatus for applying glue to chips and fibers of wood, bagasse and other cellulose containing substances, which includes in combination: chamber means having a substantially cylindrical mantle, a drive shaft rotatable within said chamber means and extending in the axial direction of said mantle, said shaft having associated therewith an axially extending glue conveying passage adapted to be connected to a supply of glue, and glue applying tools connected to said drive shaft for rotation therewith and radially outwardly extending from said shaft into the vicinity of the inner surface of said mantle for plowing through a ring of chip material to be formed on said mantle and to have glue applied thereto, each of said tools having a glue conveying conduit communicating with said glue conveying passage and each tool also having a radially outer section provided with at least one glue discharge conduit having at least one glue discharge opening adapted to direct its discharge of glue in the direction toward said mantle and thereby into a ring of chip material to be formed on said mantle and to have glue applied thereto, said at least one glue discharge conduit communicating with the respective pertaining glue conveying conduit, and said at least one glue discharge conduit being provided on the trailing side of the pertaining tool when considering the direction of rotation of the latter, each glue discharge conduit forming an acute angle opening toward said drive shaft with the pertaining glue conveying conduit, said glue applying tools including a head portion in the vicinity of the ring of chip material forming a loosening-up zone therewith, said glue discharge conduit being provided with a plurality of glue discharge openings, and at least one glue discharge opening being spaced from the respective adjacent mantle surface by such a distance as to be located radially inwardly along one side of the ring of chip material to be formed on said mantle.

2. An apparatus in combination according to claim 1, in which there is a glue discharge opening formed directly by the exit cross section of the pertaining glue discharge conduit.

3. An apparatus in combination according to claim 1, in which said glue discharge conduits are respectively formed by tubes respectively projecting from the trailing end of said tools.

4. An apparatus in combination according to claim 1, in which said glue discharge conduit has that side thereof, which faces toward that mantle portion along which the ring of chip material to be provided with glue is to be formed, provided with at least one glue discharge opening having its axis forming an angle with the longitudinal axis of said glue discharge conduit.

5. An apparatus in combination according to claim 1, in which the free end portion of said glue discharge conduits has a plurality of glue discharge openings.

6. An apparatus in combination according to claim 1, in which the trailing side of each of said tools has connected thereto two glue discharge conduits projecting from the pertaining tool and diverging from the respective tool while communicating with the glue conveying conduit of the pertaining tool.

7. An apparatus in combination according to claim 1, in which said glue discharge conduit has a glue discharge opening at its free end with the axis of said last mentioned glue discharge opening in axial alignment with the longitudinal axis of said glue discharge conduit, the plane in which said last mentioned glue discharge opening is located forming an angle with the longitudinal axis of said glue discharge conduit.

8. An apparatus in combination according to claim 7, in which said glue discharge conduit in addition to its glue discharge opening at its end also has at least one glue discharge opening through the wall defining said glue discharge conduit, said last mentioned glue discharge opening having a diameter less than the diameter of said glue discharge opening at the end of the pertaining glue discharge conduit.

9. An apparatus in combination according to claim 7, in which the glue discharge opening in the free end of said glue discharge conduits is circular.

10. An apparatus in combination according to claim 7, in which the glue discharge opening in the free end of said glue discharge conduits is elliptical.

11. An apparatus in combination according to claim 7, in which the glue discharge opening in the free end of said glue discharge conduits tapers in a nozzle-shaped manner.

12. An apparatus in combination according to claim 7, in which the glue discharge opening in the free end of said glue discharge conduits flares the discharge direction.

13. An apparatus in combination according to claim 1, in which that portion of said glue discharge conduits which is connected to the pertaining tool has an outer diameter less than the diameter of the radially outer end of the pertaining tool.

14. An apparatus in combination according to claim 1, in which the radially outer end portion of said tools has an approximately triangular cross section with the base of the triangle forming the trailing edge and the tip of the triangle forming the leading edge of the respective tool.

15. An apparatus in combination according to claim 1, in which said drive shaft is hollow having said glue conveying passage arranged therein while being provided with axially spaced threaded bores having said tools threadedly engaging said threaded bores, the glue conveying conduit of said tools being formed by a bore communicating with the interior of said hollow drive shaft.

16. An apparatus in combination according to claim 15, in which said glue discharge conduits are respectively welded to the pertaining tools while each of said tools has a connecting bore extablishing communication between the respective glue discharge conduit and the pertaining tool bore forming the glue conveying conduit.

* * * * *

UNITED STATES PATENT OFFICE

CERTIFICATE OF CORRECTION

Patent No. 4,015,830 Dated April 5, 1977

Inventor(s) Wilhelm Lödige et al.

It is certified that error appears in the above-identified patent and that said Letters Patent are hereby corrected as shown below:

On the cover sheet Item 30, should read

-- [30] Foreign Application Priority Data

July 17, 1974 Germany.....2434358 --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*